US010653915B2

(12) United States Patent
Moss

(10) Patent No.: US 10,653,915 B2
(45) Date of Patent: May 19, 2020

(54) PORTABLE AND STORABLE ABDOMINAL EXERCISE DEVICE

(71) Applicant: Jacqueline Moss, Charlotte, NC (US)

(72) Inventor: Jacqueline Moss, Charlotte, NC (US)

( * ) Notice: Subject to any disclaimer, the term of this patent is extended or adjusted under 35 U.S.C. 154(b) by 40 days.

(21) Appl. No.: 16/191,741

(22) Filed: Nov. 15, 2018

(65) Prior Publication Data

US 2019/0143170 A1 May 16, 2019

Related U.S. Application Data

(60) Provisional application No. 62/587,110, filed on Nov. 16, 2017.

(51) Int. Cl.

| | |
|---|---|
| ***A63B 23/02*** | (2006.01) |
| ***A63B 23/04*** | (2006.01) |
| ***A63B 21/00*** | (2006.01) |
| ***A63B 21/04*** | (2006.01) |
| ***A63B 21/055*** | (2006.01) |
| *A63B 5/11* | (2006.01) |
| *A63B 71/02* | (2006.01) |

(52) U.S. Cl.

CPC .... *A63B 23/0216* (2013.01); *A63B 21/00069* (2013.01); *A63B 21/0442* (2013.01); *A63B 21/0552* (2013.01); *A63B 23/0405* (2013.01); *A63B 5/11* (2013.01); *A63B 2071/026* (2013.01); *A63B 2208/0242* (2013.01); *A63B 2210/50* (2013.01); *A63B 2225/093* (2013.01)

(58) Field of Classification Search

CPC ..... A63B 23/0216; A63B 23/0405; A63B 21/00069; A63B 21/0442; A63B 21/0552; A63B 5/11; A63B 2071/026; A63B 2225/093; A63B 2210/50; A63B 2208/0242; A63B 23/00–0405; A63B 2023/003–006; A63B 2023/0411

See application file for complete search history.

(56) References Cited

U.S. PATENT DOCUMENTS

| | | | | |
|---|---|---|---|---|
| 4,371,162 | A * | 2/1983 | Hartzell | A63B 21/04 482/123 |
| 4,606,539 | A * | 8/1986 | Farnham | A63B 21/0023 482/148 |
| 5,160,303 | A * | 11/1992 | Smith | A63B 21/055 482/123 |
| 5,514,058 | A * | 5/1996 | Buoni | A63B 21/0004 482/124 |
| 5,882,284 | A * | 3/1999 | Cayne | A63B 23/0211 482/123 |
| 6,595,904 | B1 * | 7/2003 | Staffa | A63B 21/0552 482/101 |
| 2002/0160891 | A1 * | 10/2002 | Gallagher | A63B 21/04 482/123 |

(Continued)

*Primary Examiner* — Andrew S Lo

(74) *Attorney, Agent, or Firm* — NCCU School of Law-IP Clinic; Joshua Richardson; De'Von Carter

(57) ABSTRACT

An exercise device is portable and includes a steady platform with adjustable height and an adjustable resistance band. A user is able to utilize and interact with the device while lying on the ground. The device has an elastic band that is connected to two parallel vertical sides that are attached to a weighted stabilizing base. The height of the device can be adjusted to achieve different impact during the workout. The elastic band can be interchanged to vary the resistance level.

8 Claims, 13 Drawing Sheets

(56) References Cited

U.S. PATENT DOCUMENTS

2004/0067827 A1* 4/2004 Tustin ..... A63B 21/0004
482/121
2004/0102296 A1* 5/2004 Dubrul ..... A63B 21/00181
482/141
2004/0147380 A1* 7/2004 Mattox ..... A63B 21/0004
482/139
2005/0130817 A1* 6/2005 Sjuragri ..... A63B 21/00047
482/142
2007/0249971 A1* 10/2007 Doran ..... A63B 21/04
601/27
2009/0270231 A1* 10/2009 Hall ..... A63B 21/0552
482/79
2009/0305854 A1* 12/2009 Brown, Jr. ..... A63B 21/04
482/140
2010/0234194 A1* 9/2010 Shaffer ..... A63B 21/0552
482/140
2012/0138113 A1* 6/2012 Spinabella ..... A47B 97/00
135/66
2012/0238421 A1* 9/2012 Klopman ..... A63B 7/085
482/142
2012/0302412 A1* 11/2012 Nail ..... A63B 21/0442
482/129
2014/0087928 A1* 3/2014 Luedeka ..... A63B 21/4023
482/130
2014/0228186 A1* 8/2014 Montgomery ..... A63B 23/0494
482/139
2015/0157890 A1* 6/2015 Klopman ..... A63B 7/085
482/142
2015/0367159 A1* 12/2015 Harris ..... A63B 21/0557
482/122
2017/0072242 A1* 3/2017 Drain, II ..... A63B 21/068

* cited by examiner

PORTABLE AND STORABLE ABDOMINAL EXERCISE DEVICE

CROSS-REFERENCE TO RELATED APPLICATIONS

This application claims the benefit of U.S. Provisional Application No. 62/587,110, filed Nov. 16, 2017, which is hereby incorporated in its entirety.

FIELD OF THE INVENTION

The present invention pertains to an exercise device and, more particularly, to a portable exercise device that includes a steady platform with adjustable height and an adjustable resistance band.

BACKGROUND OF THE INVENTION

The following description is not an admission that any of the information provided herein is prior art or relevant to the present invention, or that any publication specifically or implicitly referenced is prior art. Any publications cited in this description are incorporated by reference herein. Where a definition or use of a term in an incorporated reference is inconsistent or contrary to the definition of that term provided herein, the definition of that term provided herein applies and the definition of that term in the reference does not apply.

Exercise is physical activity that promotes a healthy lifestyle. Scientific research shows that individuals who exercise regularly are healthier physically and mentally, have more energy, think more clearly, and sleep better. According to research, exercise also plays a significant role in improving an individual's overall mental health. Even exercising for only thirty minutes a day has proven to minimize the average individual's risk of stroke, heart disease, and diabetes. People have different exercise needs and abilities. It is important for exercise devices to be adjustable so that both novices and experts can receive a benefit from the device. While exercise is vital to maintaining good health, often people find it difficult to find time to go to the gym. People also need variety in their workout routines. Further, with an increasingly transient business environment, people struggle to adequately exercise while travelling. Thus, it is desirable to provide an exercise device that is portable, storable, stable, and adjustable to vary one's workout regimen.

Generally, current exercise devices are deficient in addressing these various needs of individuals. For example, exercise devices that are portable often do not have the stability or adjustability to provide workout variety. Exercise devices that do have adjustability to vary exercises largely lack efficient portability and storability. Because of these deficiencies in the prior art, there is a need for an exercise apparatus that is portable, storable, and adjustable.

Many attempts have been found in the prior art to overcome the deficiencies discussed above. For example, U.S. Pat. No. 9,061,172 describes an exercise apparatus that is collapsible, and thus portable, which uses elastic bands with adjustable tension. This device, however, is not stabilized and the height is not adjustable. Because this device is not adjustable, it needs to be modified in order to provide a variety of workouts.

Other exercise machines that target the abdomen and are portable, comprise unsteady exercise platforms. (see, e.g., US Patent Application Publication No. 2008/0318743). This reference provides a workout that may be too strenuous for novices and/or the elderly. Further, this device is too complex to assemble and to adjust to a particular workout.

Therefore, there exists a need for a portable, adjustable, relatively low-impact, and storable exercise device.

SUMMARY OF THE INVENTION

The present invention is directed to a portable and storable abdominal exercise device which features a rebound or trampoline bounce element while a user lies on the ground and interacting with the device. In an embodiment, the device is designed to strengthen and tone the core and lower body areas of a user without negatively impacting or straining bones or joints.

In one embodiment, the device comprises an elastic band that is connected to two parallel vertical sides that are attached to a weighted stabilizing base. The height of the parallel vertical sides can be adjusted to achieve different impact levels during the workout. The elastic band can be tightened at the point of attachment to the parallel vertical sides to provide increased resistance, or loosened, to provide decrease resistance.

In a workout session, a user interacts with the exercise device by lying on the ground and positioning his/her body in different positions with his/her feet performing various bouncing actions. As an option, the intensity of the workout session can be increased by using hand weights which would encompass a full body workout.

In an exemplary embodiment, the weighted stabilizing base is compact and convenient to carry and store. Furthermore, since the device is stable, the user is not required to balance himself/herself during a workout session while utilizing the abdominal device. Additionally, the elastic band can be tightened to increase resistance by the use of a cylinder which is located at the point of attachment between the vertical parallel sides and the elastic band. When the cylinder is rotated in the direction away from the center of the device, the band is tightened. When the cylinder is rotated towards the center of the device, the band is loosened. Moreover, the device eliminates the use of bulky chairs or heavy equipment that occupy space and offer no mobility. The exercise device is suitable for all levels of fitness and age, including the elderly, who often suffer from joint issues.

The device can be used for home exercise, and corporate exercise programs in gyms, fitness, health, and sports clubs. Furthermore, the device can also be used for athletic training as well. Core strengthening provides stability and balance, which are key elements needed to be a well-rounded athlete. In addition, the device provides rehabilitative and therapeutic benefits while using this device, as well as core strengthening.

In one embodiment, a portable abdominal exercise device comprises an elastic band, a first parallel vertical side comprising a top and a bottom, a second parallel vertical side comprising a top and a bottom, a weighted stabilizing base comprising a top side and a bottom side, a first handle, and a second handle. In this embodiment, the first parallel vertical side is permanently attached to the top side of the weighted stabilizing base, and the second parallel vertical side is permanently attached to the top side of the weighted stabilizing base. Further, the first handle is attached to said top of the first parallel vertical side. In an embodiment, the second handle is attached to the top of said second parallel vertical side. In another embodiment, the elastic band is removably attached to the top of the first parallel vertical side and the top of the second parallel vertical side.

In a further embodiment, the elastic band comprises rubber, polymers, silicone, vinyl, neoprene, or any combination thereof.

In another embodiment, a first parallel reinforcement structure, and a second parallel vertical structure are permanently attached to the weighted stabilizing base.

In yet another embodiment, the first and second parallel vertical sides are vertically adjustable.

In a further embodiment, the weighted stabilizing base comprises metal, plastic, or any combination thereof.

In still another embodiment, the elastic band is connected to the first and said second parallel vertical sides at the first and the second cylinders, respectively, by removable adhesive, hook-and-loop tape, buttons, screws, bolts, or any combination thereof.

In another embodiment, a portable abdominal exercise device, comprises a elastic band, a first parallel vertical side having a top and a bottom, second parallel vertical side with a top and a bottom, a weighted stabilizing base, a top side, and a bottom side, a first handle, a second handle, a first cylinder removably attached to the top of the first vertical parallel side via a crank and a first fastener, and a second cylinder removably attached to the top of the second vertical parallel side via a second fastener and a third fastener. In this embodiment, the first parallel vertical side is permanently attached to the top side of the weighted stabilizing base, and the second parallel vertical side is permanently attached to the top side of said weighted stabilizing base. Further in this embodiment, the first handle is attached to the top of the first parallel vertical side. In this embodiment, the second handle is attached to the top of the second parallel vertical side. In addition, the elastic band is attached to the first cylinder and the second cylinder. In this embodiment, the crank is configured to rotate the first cylinder. Further in this embodiment, the crank is attached to the first cylinder at the first cylinder. In this embodiment the first cylinder is locked into position by the attachment of the first fastener to the first cylinder and by the attachment of the first fastener to said first cylinder.

In an embodiment, the second cylinder is locked into position by the attachment of the second fastener to the second cylinder and by the attachment of the third fastener to the second cylinder.

In another embodiment, the elastic band comprises rubber, polymers, silicone, vinyl, neoprene, or any combination thereof.

In yet another embodiment, the elastic band is connected to the first and said second parallel vertical sides at the first and the second cylinders, respectively, by removable adhesive, hook-and-loop tape, buttons, screws, bolts, or any combination thereof.

In a further embodiment, the first and second cylinders comprise a top half and bottom half, and the elastic band is locked into place by screws between the top and bottom halves of the cylinders.

In still another embodiment, first and second parallel vertical sides are vertically adjustable.

In yet another embodiment, the weighted base comprises metal, plastic, or any combination thereof.

In a further embodiment, a portable abdominal exercise device, comprises a elastic band, a first parallel vertical side having a top and a bottom, a second parallel vertical side with a top and a bottom, a weighted stabilizing base, a top side, and a bottom side a first handle, a second handle, a first cylinder removably attached to the top of the first vertical parallel side via a crank and a first fastener, and a second cylinder removably attached to the top of the second vertical parallel side via a second fastener and a third fastener. In this embodiment, the first parallel vertical side is permanently attached to the top side of the weighted stabilizing base, and the second parallel vertical side is permanently attached to the top side of the weighted stabilizing base. The first handle is attached to the top of the first parallel vertical side. Further, the second handle is attached to said top of said second parallel vertical side. In this embodiment, the elastic band is attached to the first cylinder and the second cylinder. The crank is configured to rotate said first cylinder. In addition, the crank is attached to the first cylinder at the first cylinder. In this embodiment, the first cylinder is locked into position by the attachment of the first fastener to the first cylinder and by the attachment of the first fastener to the first cylinder. Similarly, the second cylinder is locked into position by the attachment of the second fastener to the second cylinder and by the attachment of the third fastener to the second cylinder.

In another embodiment, the weighted stabilizing base comprises a reinforced structure in a hollow body wherein the hollow body is configured to hold water, sand, or other similar material to provide stabilizing weight to the hollow body for ease of transport.

In still another embodiment, the weighted stabilizing base further comprises an opening in its top mid-section, and the opening is configured to allow the addition of water, sand or other suitable material.

In yet another embodiment, the elastic band comprises rubber, polymers, silicone, vinyl, neoprene, or any combination thereof.

In a further embodiment, the elastic band is connected to the first and said second parallel vertical sides at the first and the second cylinders, respectively, by removable adhesive, hook-and-loop tape, buttons, screws, bolts, or any combination thereof.

In another embodiment, the first and second cylinders comprise a top half and bottom half, and the elastic band is locked into place by screws between the top and bottom halves of the cylinders.

In a further embodiment, the first and second parallel vertical sides are vertically adjustable.

In yet another embodiment, the weighted base comprises metal, plastic, or any combination thereof.

Various objects, features, aspects and advantages of the inventive subject matter will become more apparent from the following detailed description of exemplary embodiments, along with the accompanying figures in which like numerals represent like components.

DETAILED DESCRIPTION

Figure 1:
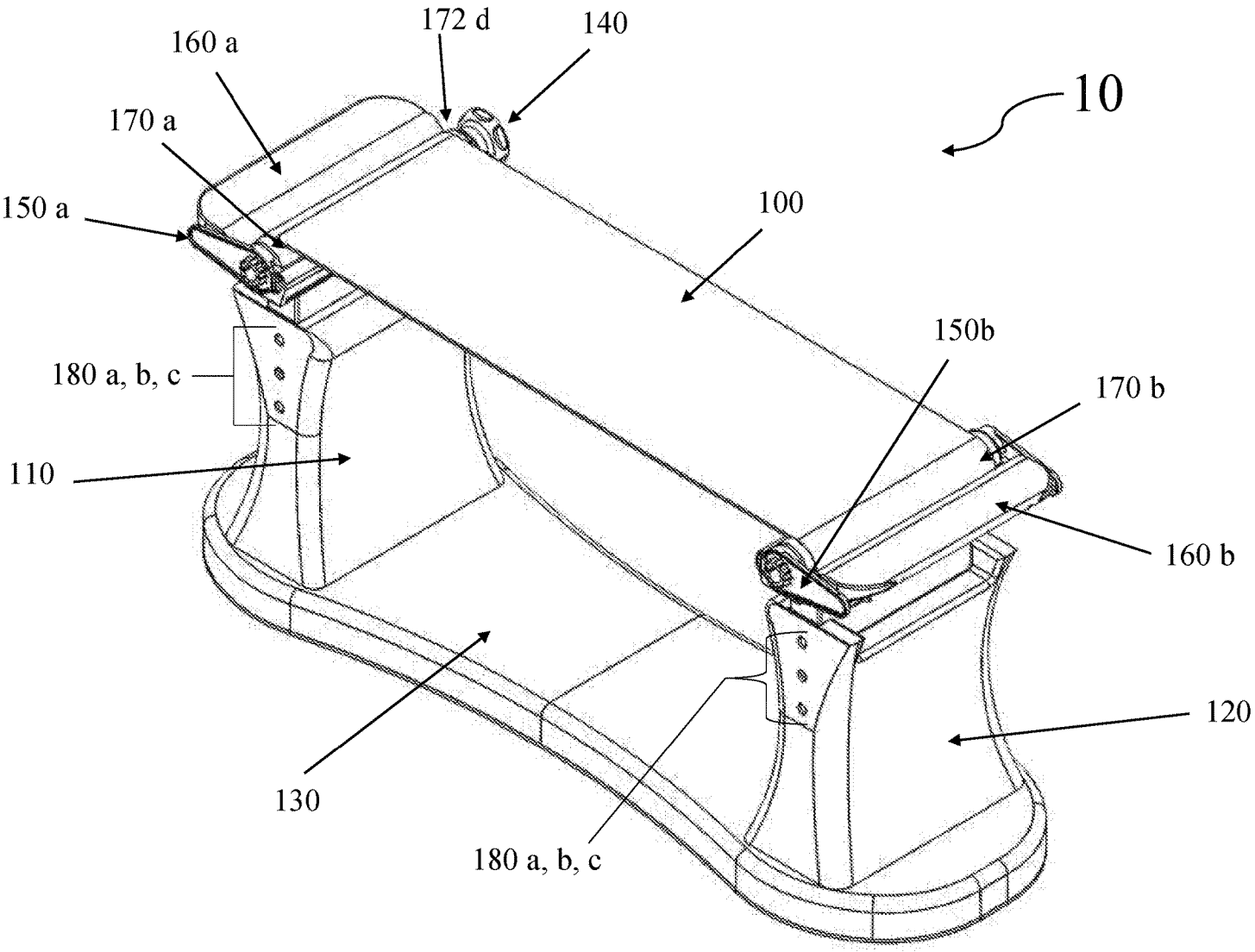
FIG. 1 is a front angled view of an exemplary configuration of the portable and storable abdominal exercise device.

A portable and storable abdominal exercise device is designed and manufactured to allow a user to lie on the ground while utilizing a rebound or trampoline bounce element to interact with the device.

As used herein, and unless the context dictates otherwise, the term "abdominal exercise device" is intended to include both a device and an exercise device. Therefore, the terms "abdominal exercise device", "exercise device" and "device" may be used interchangeably. The device is designed to strengthen and tone the core and lower body areas of a user without having any impact or straining on bones or joints of the user.

As used in the description herein and throughout the claims that follow, the meaning of "a," "an," and "the" includes plural reference unless the context clearly dictates otherwise. Also, as used in the description herein, the meaning of "in" includes "into" and "on" unless the context clearly dictates otherwise.

As used herein, the term "about" in conjunction with a numeral refers to a range of that numeral starting from 10% below the absolute of the numeral to 10% above the absolute of the numeral, inclusive.

An exemplary embodiment of the abdominal exercise device is depicted in FIGS. 1 to 4, wherein device 10 comprises elastic band 100, first parallel vertical side 110 having a top and a bottom, second parallel vertical side 120 having a top and a bottom, first handle 160*a*, second handle 160*b*, first cylinder 170*a*, second cylinder 170*b*, and weighted stabilizing base 130. In an embodiment, first and second parallel vertical sides 110 and 120 are located opposite each other on the top side of weighted stabilizing base 130. In one embodiment, first and second parallel vertical sides 110 and 120 are perpendicular in relation to weighted stabilizing base 130.

In one embodiment, the bottom of first parallel vertical side 110 is permanently attached to a top side of weighted stabilizing base 130 by a plurality of screws. In another embodiment, the bottom of second parallel vertical side 120 is permanently attached to the top side of an end of the weighted stabilizing base 130 by a plurality of screws.

In an embodiment, first cylinder 170*a* is attached to the top of first parallel vertical side 110 via crank 140 and first fastener 150*a*. In one exemplary embodiment, first cylinder 170*a* is rotated by turning crank 140. In another embodiment, crank 140 is affixed to first cylinder 170*a* by sliding onto fourth fastener attachment point 172*d*. In an embodiment, fourth fastener attachment point 172*d* comprises a toothed shaped gear. In one embodiment, crank 140 rotates first cylinder 170*a* when crank 140 is attached at fourth fastener attachment point 172*d*. In an embodiment, first fastener 150*a* locks first cylinder 170*a* into place. In another embodiment, first fastener 150*a* locks first cylinder 170*a* in place by sliding onto first fastener attachment point 172*a* and into a groove (not shown) on first parallel vertical side 110. In this embodiment, first fastener attachment point 172*a* is on an end (not shown) of first cylinder 170*a* (see FIGS. 1 to 3). In an embodiment, first fastener attachment point 172*a* comprises a gear toothed shaped structure. This assembly prevents first cylinder 170*a* from rotating and allows free rotation before first fastener 150*a* is attached (see FIGS. 6 and 7).

In an exemplary embodiment, second cylinder 170*b* is attached to the top of second parallel vertical side 120 via second fastener attachment point 172*b* and third fastener attachment point 172*c*. In an embodiment, second fastener attachment point 172*b* and third fastener attachment point 172*c* lock second cylinder 170*b* in place and prevent second cylinder 170*b* from rotating. In another embodiment, second fastener 150*b* locks second cylinder 170*b* in place by sliding onto second fastener attachment point 172*b* and into a groove (not shown) on second parallel vertical side 120. In this embodiment, second fastener attachment point 172*b* is on the end of second cylinder 170*b*. In an embodiment, third fastener 150*c* locks second cylinder 170*b* in place by sliding onto third fastener attachment point 172*c* and into a groove (not shown) on second parallel vertical side 120. In this embodiment, third fastener attachment point 172*b* is on the end (not shown) of second cylinder 170. In one embodiment, second fastener attachment point 172*b* and third fastener attachment point 172*c* comprise gear toothed shaped structures. This assembly prevents second cylinder 170*b* from rotating by the attachment of second fastener 150*b* and third fastener 150*c* (see FIGS. 1 to 3, 6 and 7).

Figure 8:
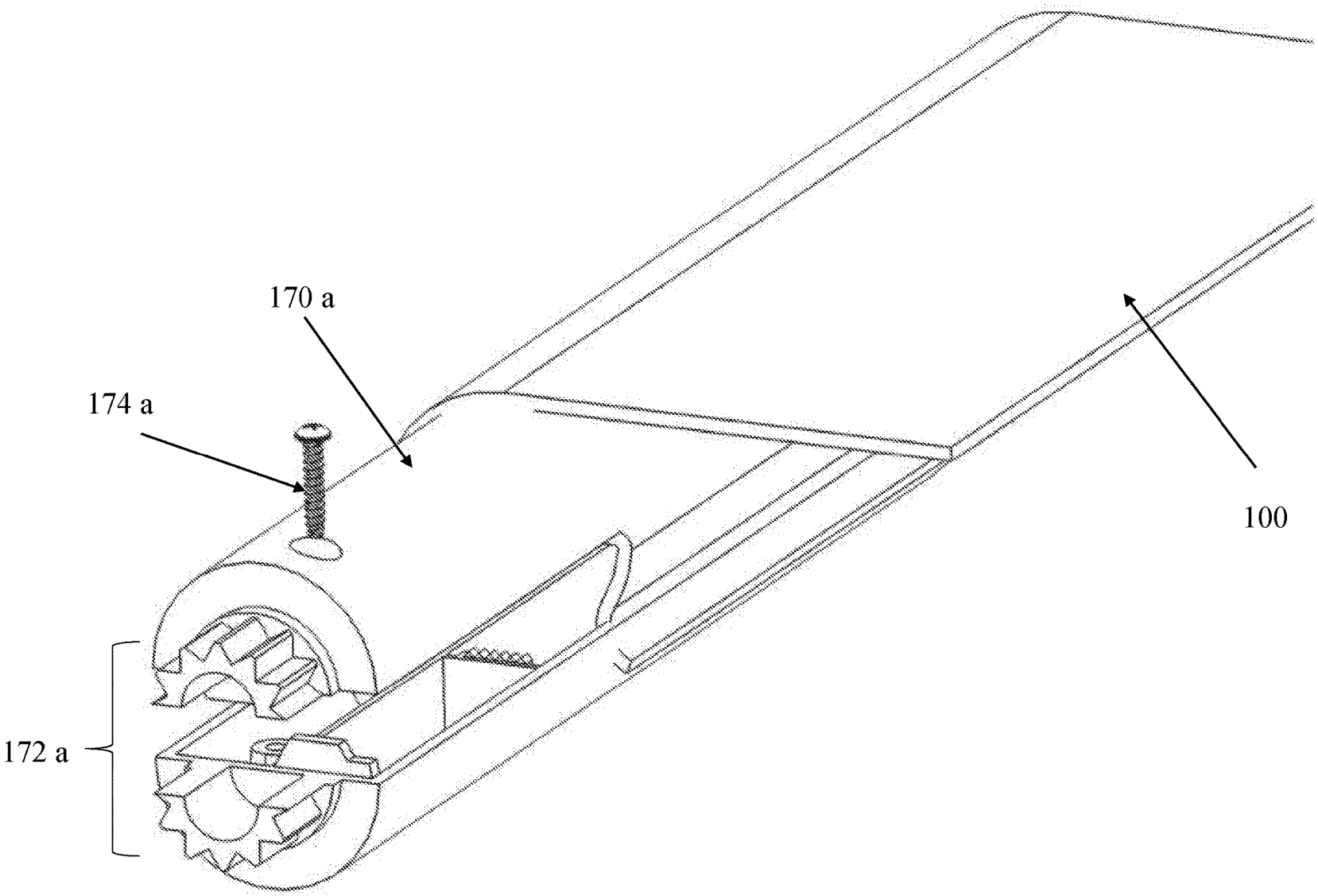
FIG. 8 is a top view of the first cylinder of an exemplary configuration of the portable and storable abdominal exercise device with a removably attached elastic band.
Figure 9:
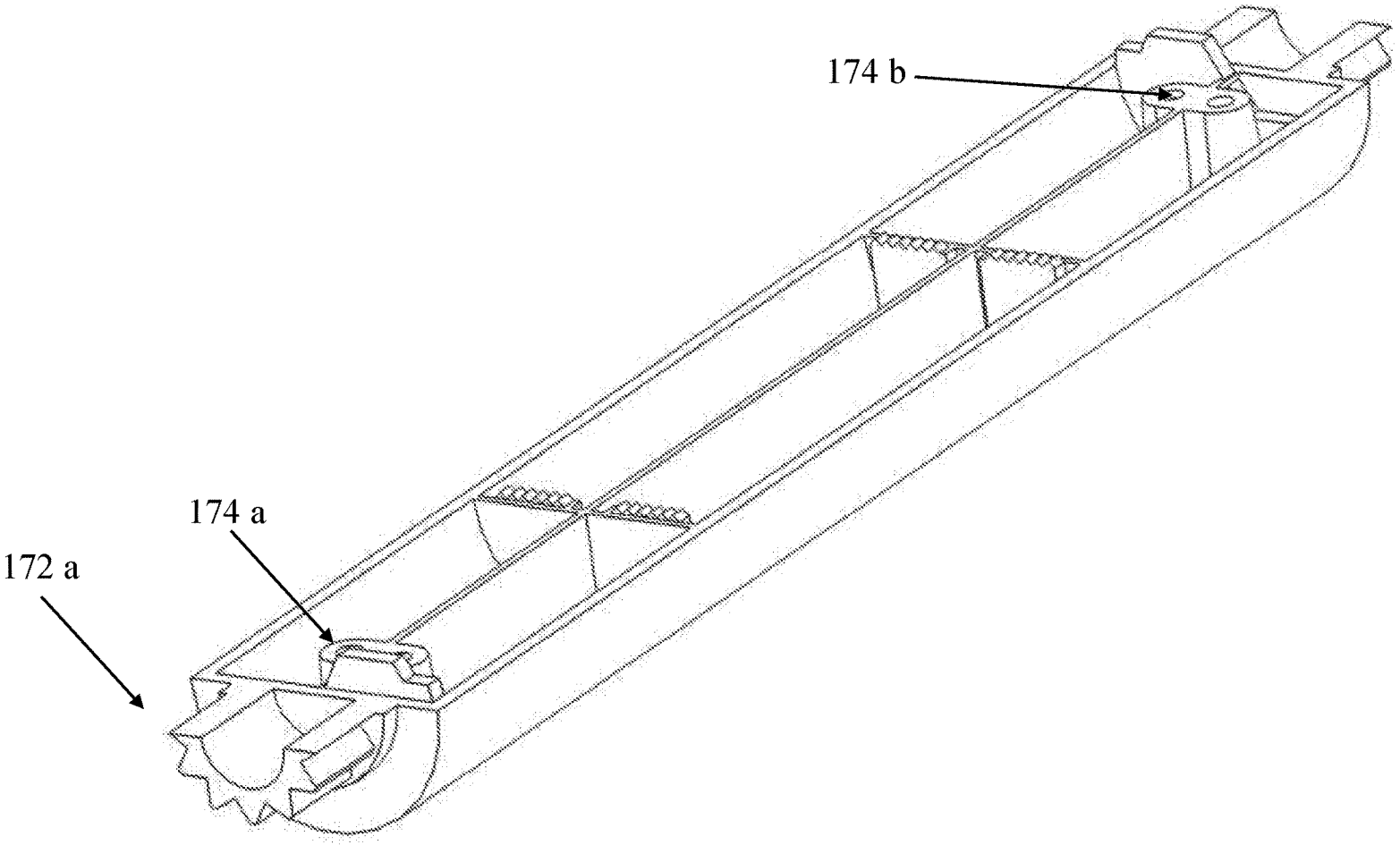
FIG. 9 is a cross-sectional view of the first cylinder of an exemplary configuration of the portable and storable abdominal exercise device.

In an embodiment, elastic band 100 is attached to first cylinder 170*a* and second cylinder 170*b* (see FIGS. 1 to 4). FIGS. 8 and 9 illustrate one embodiment of the attachment between elastic band 100 and first cylinder 170*a*. In this embodiment, first and second cylinders 170*a* and 170*b* each comprise two discrete halves, which are secured together at attachment points 174*a* and 174*b*, respectively. When cylinder halves are secured, elastic band 100 is locked in place between the two-cylinder halves.

In a further embodiment, elastic band 100 is mounted onto first and second parallel vertical sides 110 and 120 by a plurality of threaded fasteners, whereby a plurality of fasteners engage with a plurality of threaded nuts affixed to first and second parallel vertical sides 110 and 120 (not shown). The plurality of threaded nuts can be tightened or loosened to allow a user to increase or decrease tension on elastic band 100.

In one embodiment, elastic band 100 comprises rubber. In another embodiment, elastic band 100 comprises rubber and a reinforcement strip. In an embodiment, elastic band 100 comprises rubber, polymers, silicone, vinyl, neoprene, or any combination of thereof. In a further embodiment, elastic band 100 is connected to first and second parallel vertical sides 110 and 120 with a removable adhesive, such as heavy-duty hook-and-loop tape, making elastic band 100 removable (not shown). In this embodiment, elastic band 100 can be interchanged with a higher or lower tension resistance band. In a further embodiment, elastic band 100 can be interchanged to vary the resistance level of device 10. In another embodiment, a plurality of elastic bands 100 can be used simultaneously to increase the tension. In a further embodiment, elastic band 100 can be snapped onto first cylinder 170*a* and second cylinder 170*b* at various attachment points with the use of buttons for easy removal and attachment of elastic bands 100 of different resistances to device 10 (not shown).

In another embodiment, elastic band 100 is connected to the first and second parallel vertical sides 110 and 120 by adjustable clamps (not shown). The adjustable clamps are configured to change the tension of elastic band 100

In a further embodiment, elastic band 100 can be doubled to reach the desired increase in tension (not shown). In yet another embodiment, elastic band 100 can be tripled to increase the desired resistance (not shown). In another embodiment, elastic band 100 is secured to first and second cylinders 170*a* and 170*b* by a plurality of clamps (not shown). In a further embodiment, elastic band 100 can be secured to first and second cylinders 170*a* and 170*b* by clasps (not shown). In an embodiment, elastic band 100 can be secured to the first and second cylinders 170*a* and 170*b* by a plurality of latches (not shown).

Figure 6:
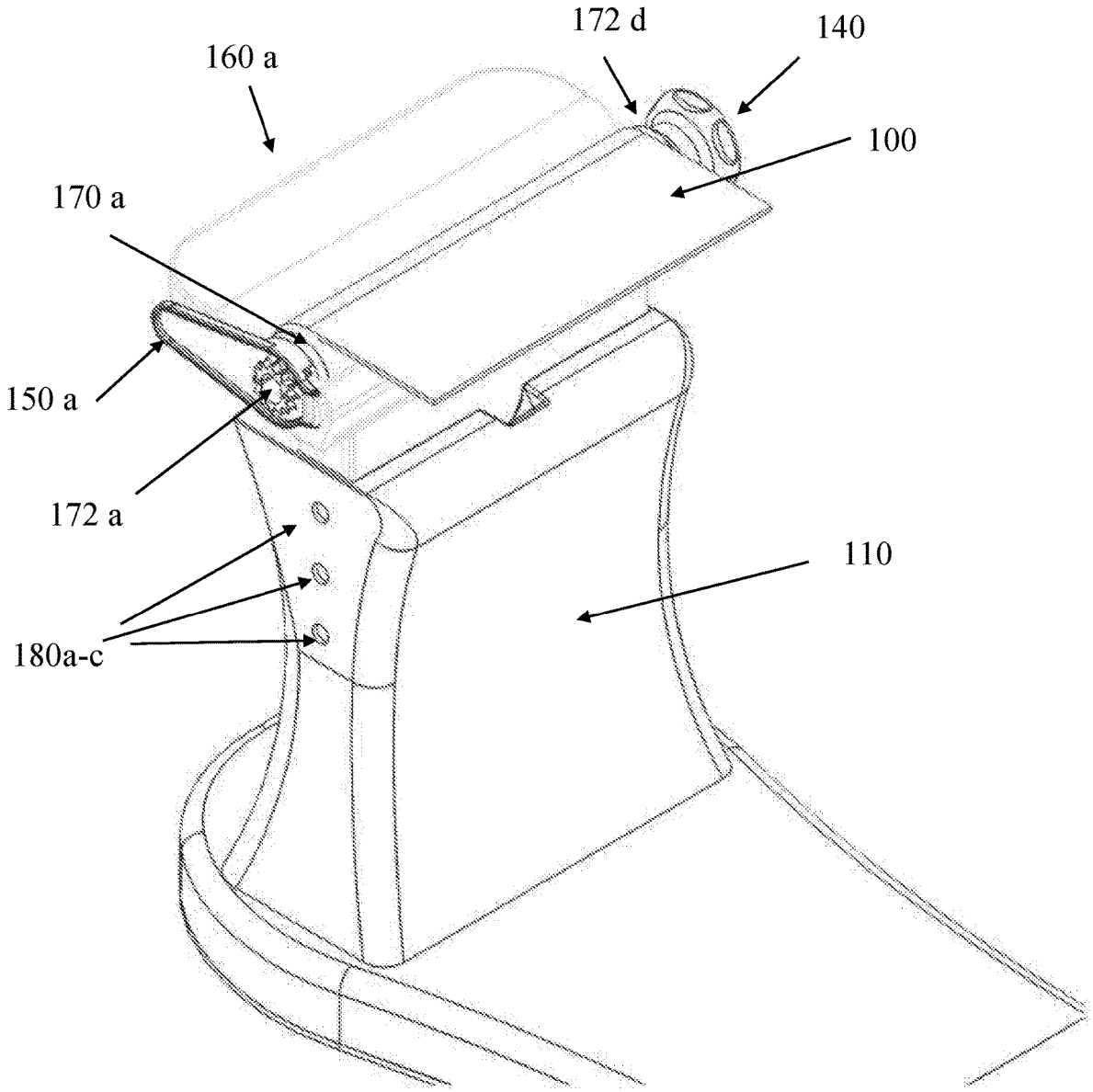
FIG. 6 is an angled view of the first vertical parallel side that depicts the first fastener maintaining the first cylinder in a fixed position.
Figure 7:
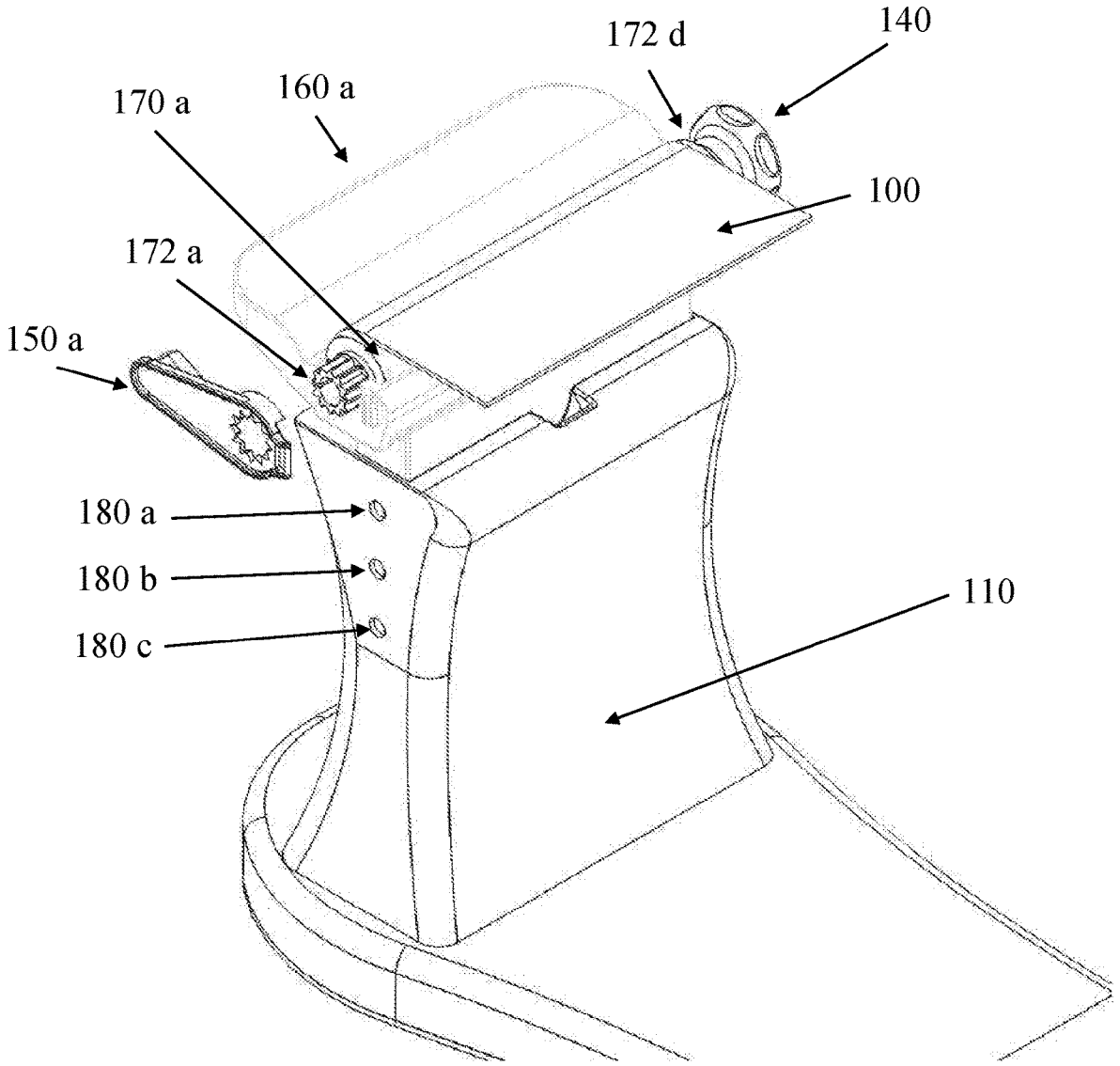
FIG. 7 is an angled view of the first vertical parallel side that depicts how the fastener maintains the first cylinder in a fixed position by attaching to the first fastener attachment point.

In an embodiment, crank 140 is configured to rotate first cylinder 170*a* to tighten or loosen elastic band 100. Once elastic band 100 has been adjusted to the desired tension, first cylinder 170*a* is locked into place by first fastener 172*a*, as depicted in FIGS. 6 and 7. In one embodiment, rotation of crank 140 towards first parallel vertical side 110 results in tightening elastic band 100 to provide more tension. In another embodiment, rotation of crank 140 towards second parallel vertical side 120 results in loosening elastic band 100 to lessen the tension.

In another embodiment, first and second cylinders 170*a* and 170*b* are held in place by one or more clamps (not shown). In a further embodiment, first and second cylinders 170*a* and 170*b* are in place by one or more clasps (not shown). In yet another embodiment, first and second cylinders 170*a* and 170*b* are held in place by one or more latches (not shown).

In an embodiment, first handle 160*a* is permanently attached to the top of first parallel vertical side 110. In another embodiment, second handle 160*b* is permanently attached to the top of second parallel vertical side 120 (see FIGS. 1 to 4).

In one embodiment, first and second parallel vertical sides 110 and 120 and weighted stabilizing base 130 are manufactured from metal to preserve the structural integrity of device 10. In another embodiment, weighted stabilizing base 130 comprises metal, plastic, or a combination thereof.

Figure 5:
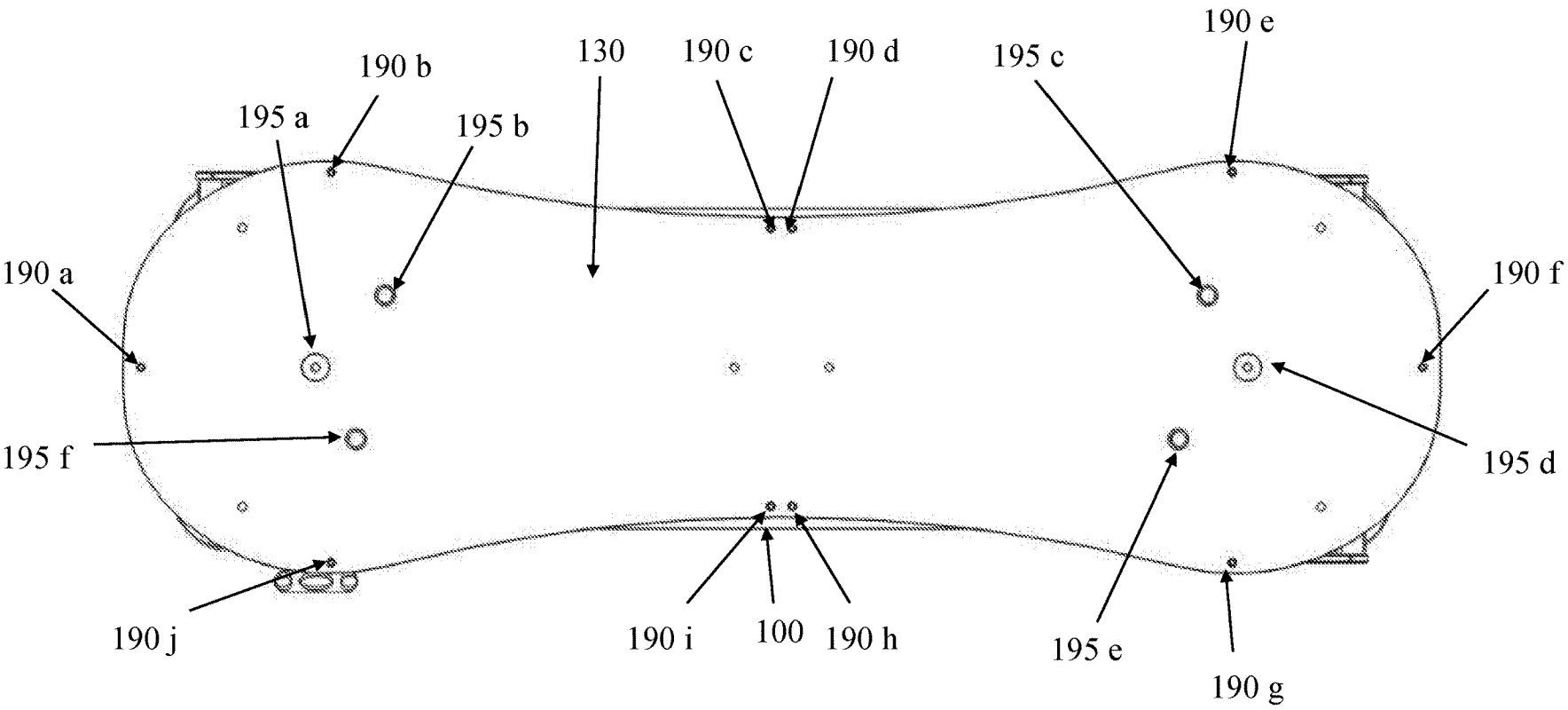
FIG. 5 is a bottom view of an exemplary configuration of the portable and storable abdominal exercise device.
Figure 10:
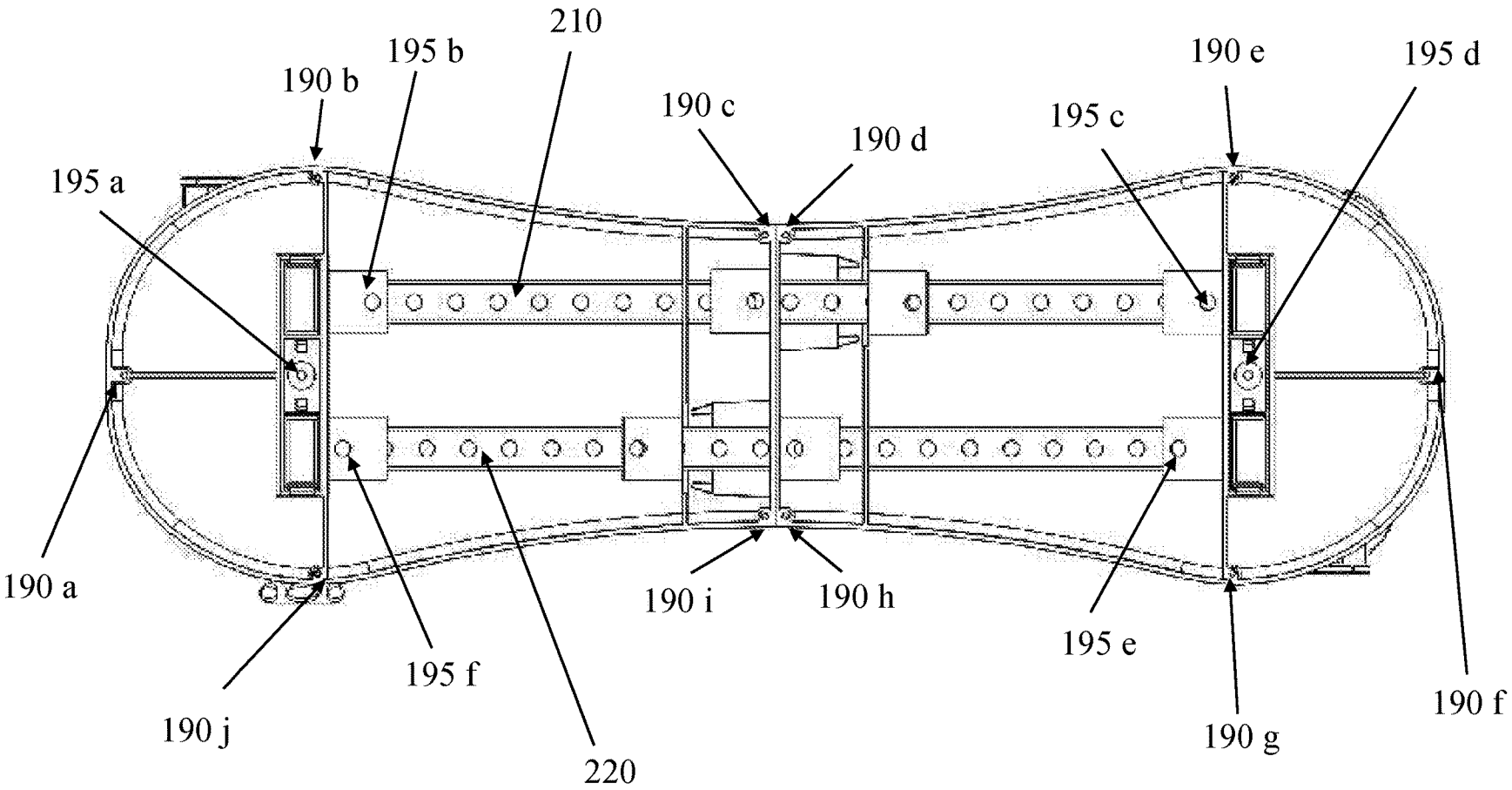
FIG. 10 is an exemplary embodiment of the bottom view of the portable and storable abdominal exercise device that depicts the first parallel reinforcement and the second parallel reinforcement structure and their attachment points.
Figure 11:
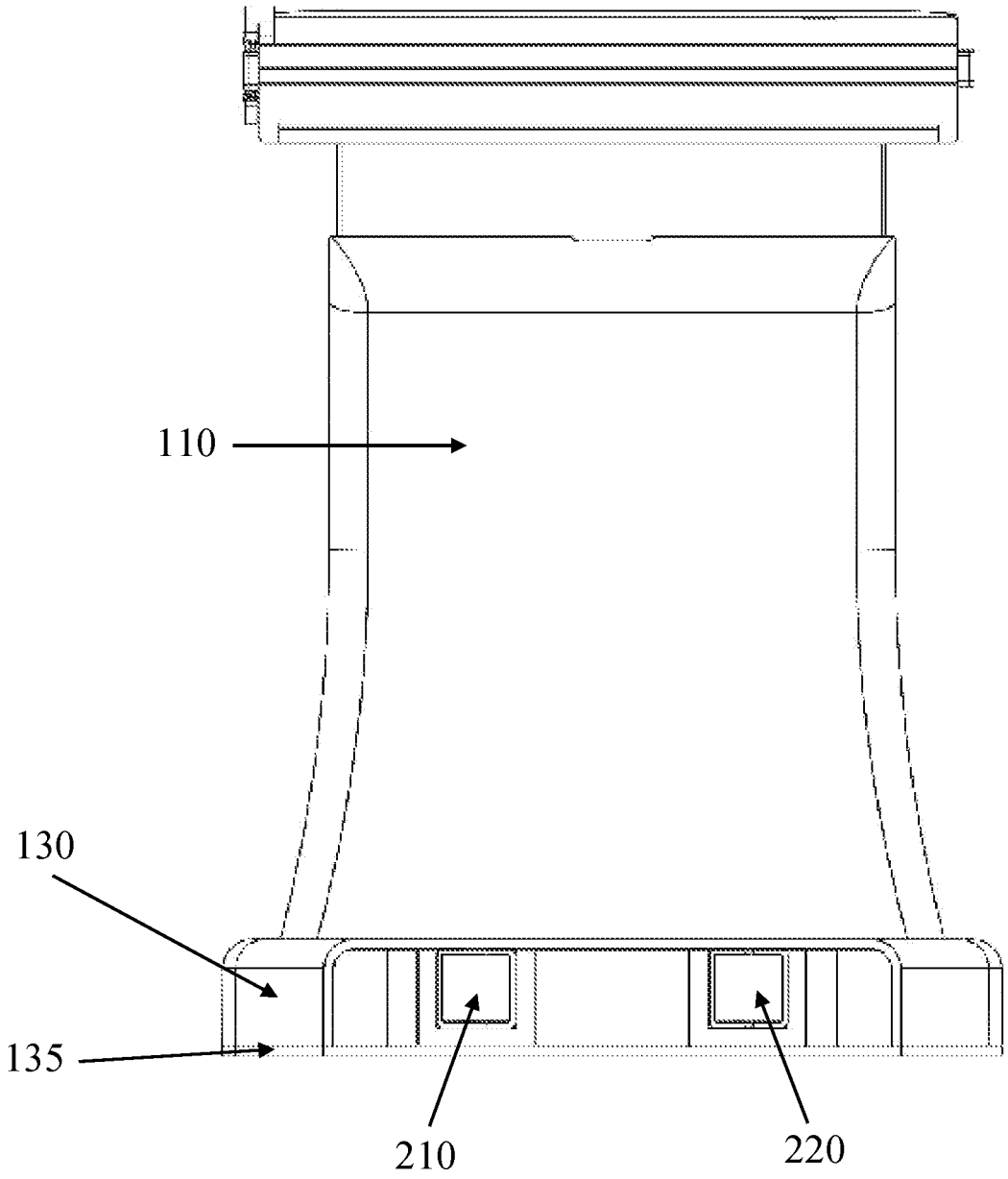
FIG. 11 is a cross-sectional view of the weighted stabilizing base that depicts the location of the first parallel reinforcement structure and the second parallel reinforcement structure within the weighted stabilizing base.
Figure 12:
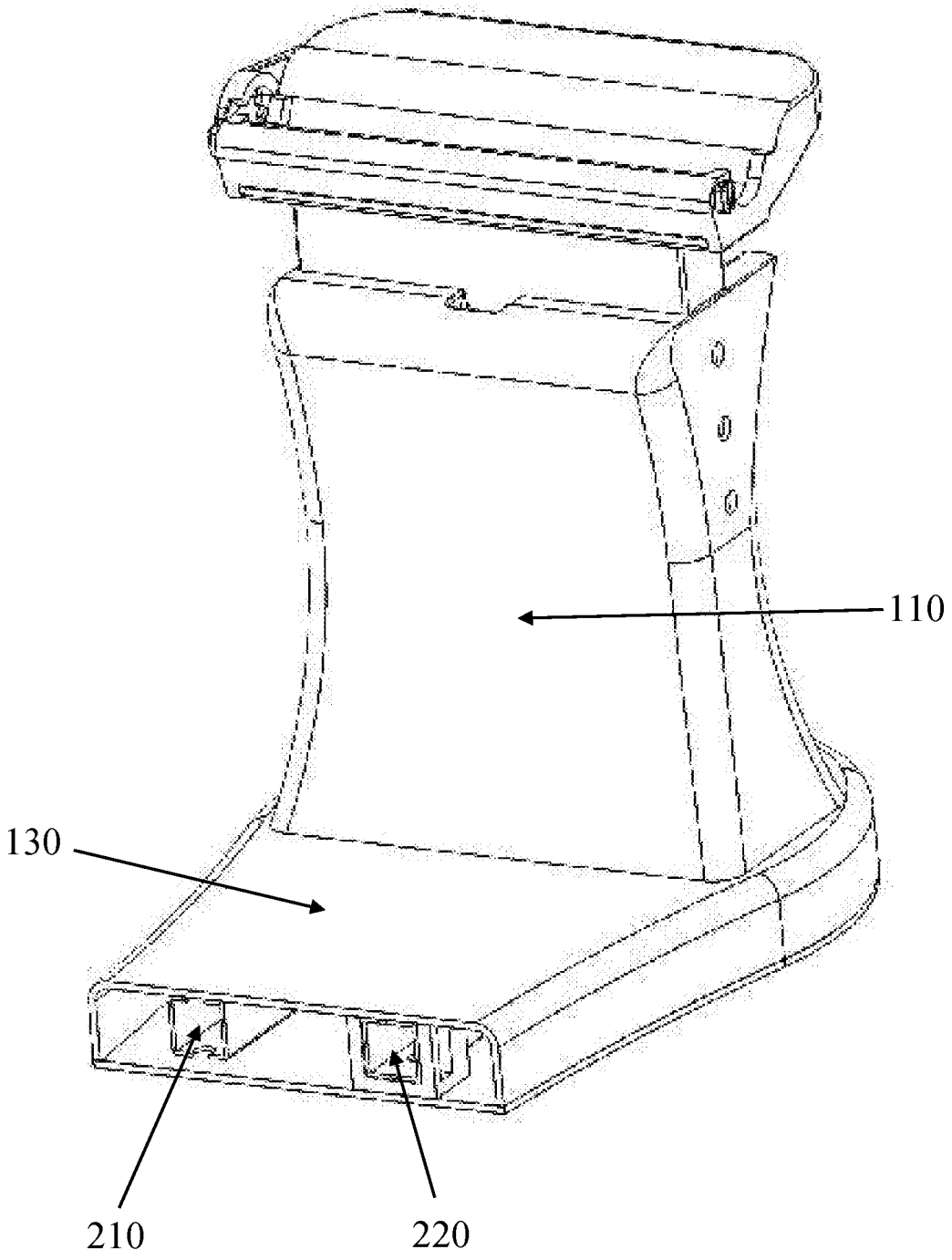
FIG. 12 is an angled cross-sectional view of the weighted stabilizing base that depicts the location of the first parallel reinforcement structure and the second parallel reinforcement structure within the weighted stabilizing base.
Figure 13:
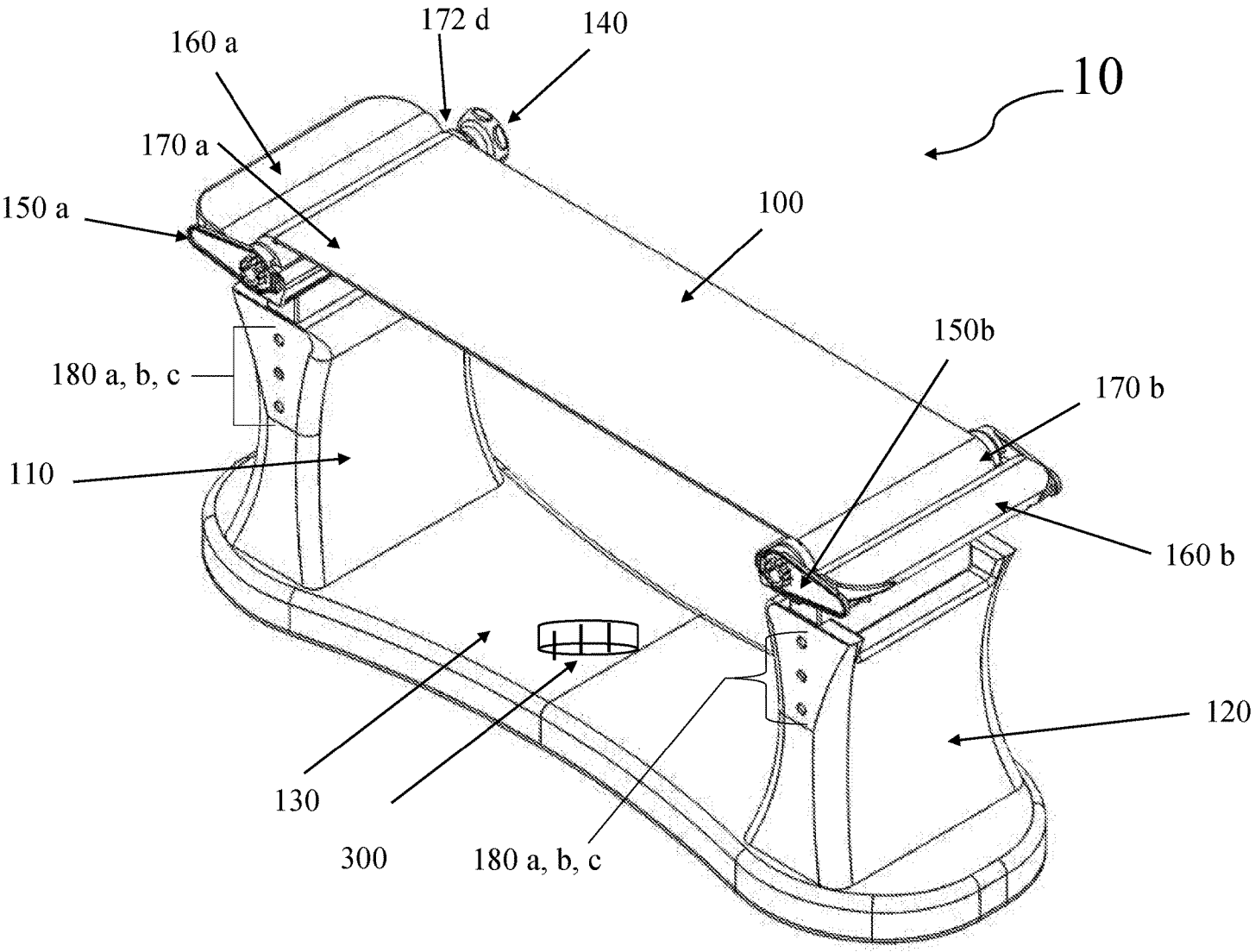
FIG. 13 is a front angled view of another exemplary configuration of the portable and storable abdominal exercise device with a cap on the weighted stabilizing base.

In another embodiment, first and second parallel vertical sides 110 and 120 and weighted stabilizing base 130 comprise first parallel reinforcement structure 210 and second parallel reinforcement structure 220 comprising metal, to prevent bowing in of device 10 during use (see FIGS. 10 to 12). In this embodiment, first and second parallel vertical sides 110 and 120 and weighted stabilizing base 130 are manufactured of materials such as high density polyethylene (HDPE), composite or other similar plastic material. In one embodiment as depicted in FIG. 5, plurality of screws 190*a* to *j* are configured to secure cover 135 to the reinforcement structure, and screws 195*a* to *f* are configured to secure first parallel reinforcement structure 210 and second parallel reinforcement structure 220 to device 10 (see FIGS. 5 and 10). In this embodiment cover 135 is manufactured of materials such as HDPE, composite or other similar plastic material. Cover 135 is configured to provide structural integrity to weighted stabilizing base 130. In one embodiment, weighted stabilizing base 130 comprises a solid and weighted material. In another exemplary embodiment, weighted stabilizing base 130 comprises a reinforced structure in a hollow body wherein the hollow body is configured to hold water, sand, or other similar material to provide stabilizing weight to the hollow body for ease of transport. In this embodiment, weighted stabilizing base 130 comprises an opening in its top mid-section 300. In an embodiment, opening 300 is configured to allow addition of water, sand or other suitable material that provides more stability and weight so that device is lighter for transport. In one exemplary embodiment, opening 300 comprises a screw top, removable plug or other access port, to allow ease of accessing hollow weighted stabilizing base 130 (FIG. 13). In an embodiment, weighted stabilizing base 130 is about 1 to about 10 pounds. In an embodiment, weighted stabilizing base 130 comprises generally an oval, or rectangular shape. In yet another embodiment, weighted stabilizing base 130 comprises flared edges to have a wider stabilizing portion (not shown).

Figure 2:
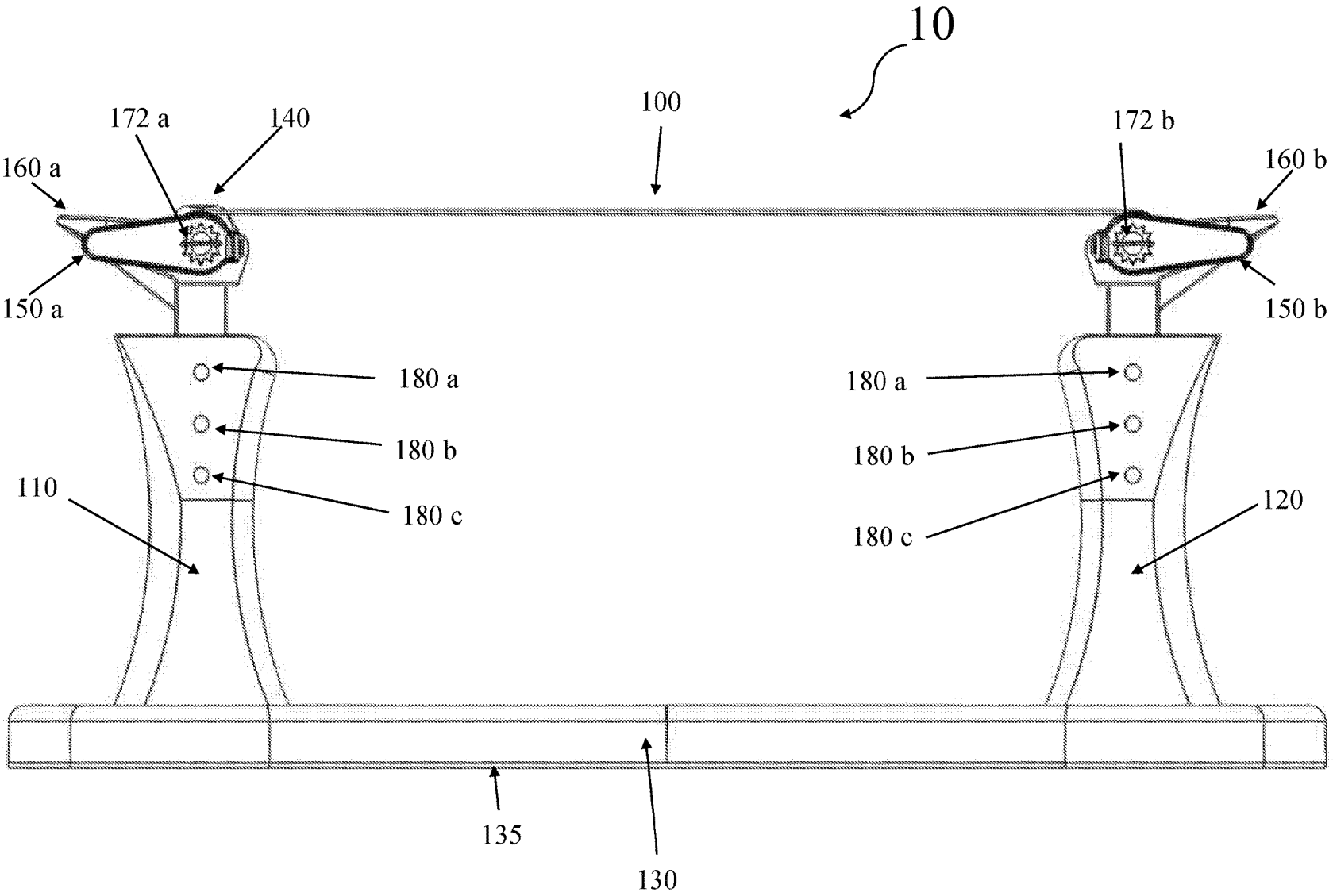
FIG. 2 is a front view of an exemplary configuration of the portable and storable abdominal exercise device.
Figure 3:
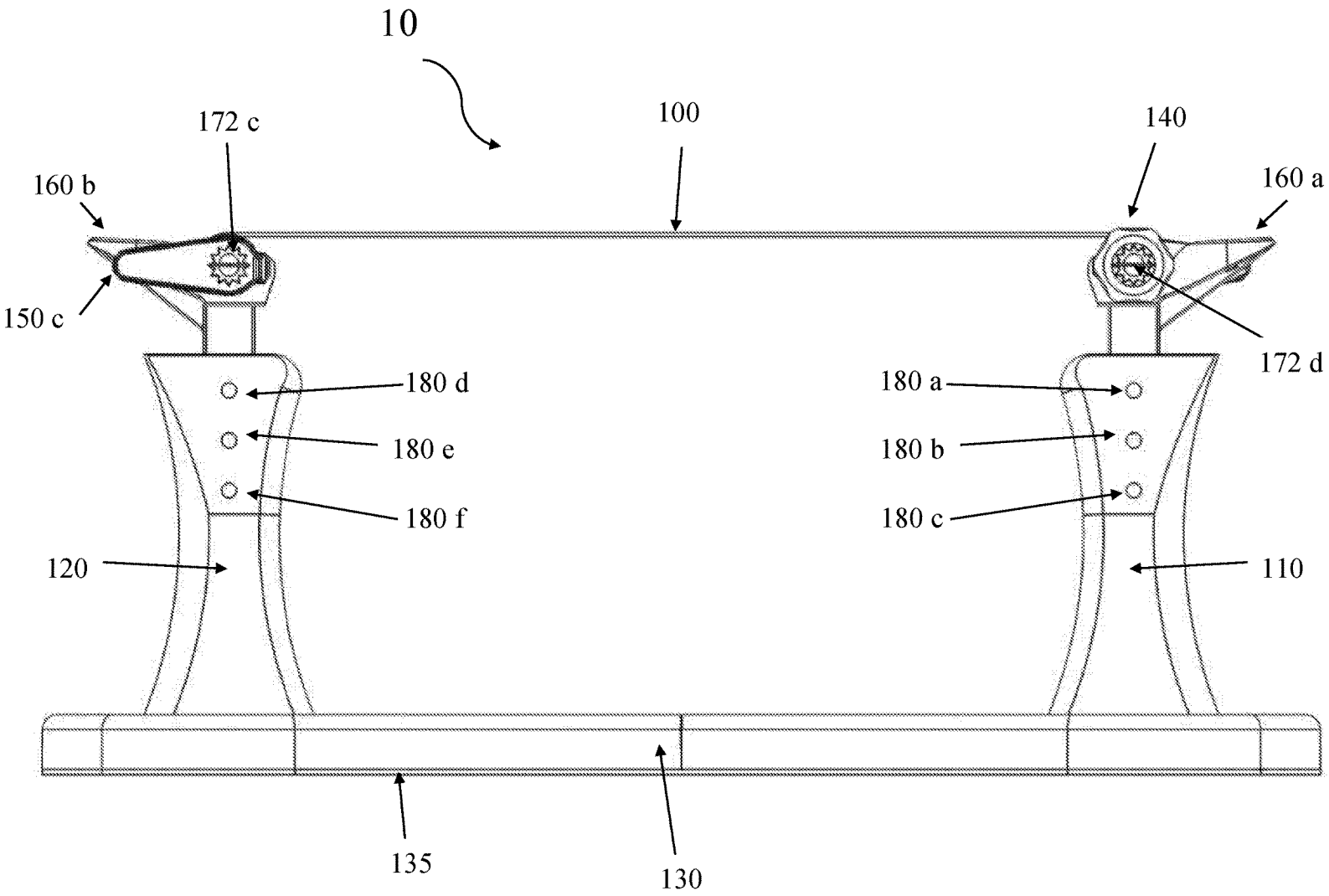
FIG. 3 is a back view of an exemplary configuration of the portable and storable abdominal exercise device.
Figure 4:
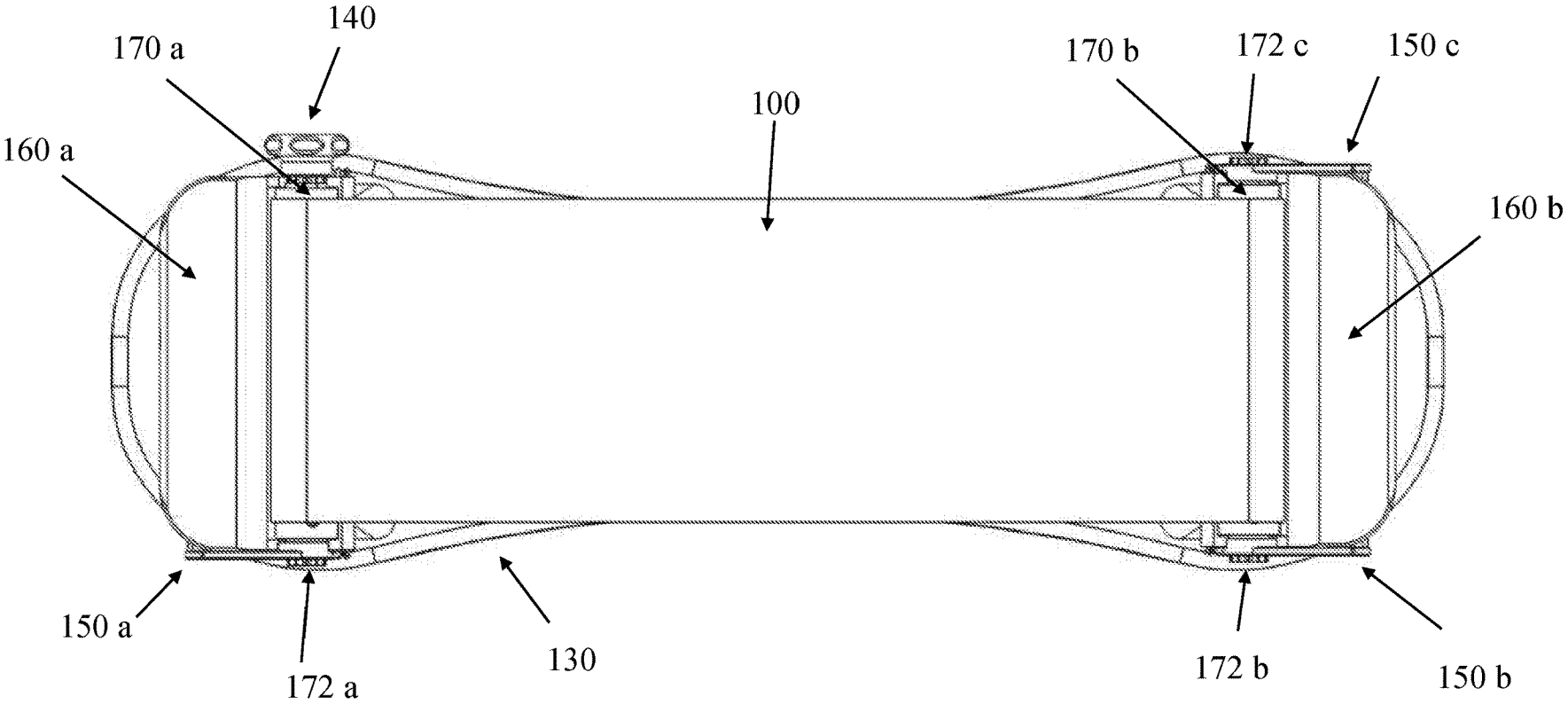
FIG. 4 is a top view of an exemplary configuration of the portable and storable abdominal exercise device.

FIGS. 2 and 3 exemplify vertically adjustable portions of first and second parallel vertical sides 110 and 120, respectively, that can be vertically adjusted for a different impact level during the workout. After adjusting first and second parallel vertical sides 110 and 120 to reach a desired height of device 10, a pin is inserted in one of vertical adjustment slots 180*a*, 180*b*, or 180*c* on both sides of first parallel vertical side 110 and second parallel vertical sides 120 to maintain the adjusted height of device 10.

In one embodiment, length of weighted stabilizing base 130 is about 20 inches to about 54 inches. In yet another embodiment, length of weighted stabilizing base 130 is about 24 inches to about 48 inches. In an embodiment, length of weighted stabilizing base 130 is about 28 inches to about 37 inches.

In an embodiment, the width of weighted stabilizing base 130 is about 6 inches to 35 inches. In yet another embodiment, the width of weighted stabilizing base 130 is about 8 inches to about 20 inches. In one embodiment, first and second parallel vertical sides 110 and 120 are about 5 inches to 30 inches high. In another embodiment, first and second parallel vertical sides 110 and 120 are about 7 inches to about 20 inches high and can be adjusted within this range to accommodate the user's body type and individual preferences.

In another embodiment, elastic band 100 is located about 7.42 inches to about 17.42 inches from the bottom of weighted stabilizing base 130 at the low height, about 8.67 inches to about 18.67 inches at the mid height from the bottom of weighted stabilizing base 130, and about 9.92 inches to about 19.92 inches at the highest height from the bottom of weighted stabilizing base 130. In yet another embodiment, elastic band 100 is located about 6 inches to about 20 inches from the bottom of weighted stabilizing base 130 at the low height, about 10 inches to about 19 inches at the mid height from the bottom of weighted stabilizing base 130, and about 12 inches to about 22 inches at the highest height from the bottom of weighted stabilizing base 130.

Thus, specific embodiments of a portable, storable, and relatively low-impact abdominal exercise device and methods to employ such embodiments have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

The invention claimed is:

1. A portable abdominal exercise device, comprising:

(a) an elastic band;

(b) a first parallel vertical side having a top and a bottom;

(c) a second parallel vertical side with a top and a bottom;

(d) a weighted stabilizing base having a top side and a bottom side;

(e) a first handle;

(f) a second handle;

(g) a first cylinder removably attached to said top of said first parallel vertical side via a crank and a first fastener; and (h) a second cylinder removably attached to said top of said second parallel vertical side via a second fastener and a third fastener;

wherein said first parallel vertical side is permanently attached to said top side of said weighted stabilizing base, and said second parallel vertical side is permanently attached to said top side of said weighted stabilizing base;

wherein said first handle is attached to said top of said first parallel vertical side;

wherein said second handle is attached to said top of said second parallel vertical side;

wherein said elastic band is attached to said first cylinder and said second cylinder;

wherein said crank is configured to rotate said first cylinder;

wherein said crank is attached to said first cylinder; and wherein said first cylinder is locked into position by the attachment of said first fastener to said first cylinder and by the attachment of said first fastener to said first cylinder; and wherein said second cylinder is locked into position by the attachment of said second fastener to said second cylinder and by the attachment of said third fastener to said second cylinder.

2. The device of claim 1, wherein said weighted stabilizing base comprises a reinforced structure in a hollow body wherein said hollow body is configured to hold water or sand to provide stabilizing weight to the hollow body for ease of transport.

3. The device of claim 1, wherein said weighted stabilizing base further comprises an opening in its top mid-section, and wherein said opening is configured to allow addition of water or sand.

4. The device of claim 1, wherein said elastic band comprises rubber, polymers, silicone, vinyl, neoprene, or any combination thereof.

5. The device of claim 1, wherein said elastic band is connected to said first and said second parallel vertical sides at said first and said second cylinders, respectively, by removable adhesive, hook-and-loop tape, buttons, screws, bolts, or any combination thereof.

6. The device of claim 1, wherein said first and second cylinders each comprises a top half and bottom half, and wherein said elastic band is locked into place by screws between said top and bottom halves of said cylinders.

7. The device of claim 1, wherein said first and second parallel vertical sides are vertically adjustable.

8. The device of claim 1, wherein said weighted stabilizing base comprises metal, plastic, or any combination thereof.

* * * * *